US006014572A

United States Patent [19]

Takahashi

[11] Patent Number: 6,014,572

[45] Date of Patent: Jan. 11, 2000

[54] ALERTING DEVICE FOR USE WITH A PAGER

[75] Inventor: Satoshi Takahashi, Shizuoka, Japan

[73] Assignee: NEC Corporation, Tokyo, Japan

[21] Appl. No.: 08/892,906

[22] Filed: Jul. 15, 1997

[30] Foreign Application Priority Data

Jul. 16, 1996 [JP] Japan ..... 8-186439

[51] Int. Cl.[7] ..... H04Q 7/20

[52] U.S. Cl. ..... 455/567; 455/31.3; 455/38.2; 455/38.4; 340/311.1; 340/825.44

[58] Field of Search ..... 455/567, 38.4–38.2, 455/38.1, 227, 228, 208, 31.2, 31.3; 340/825.44, 825.47, 825.52, 568, 506, 311.1

[56] References Cited

U.S. PATENT DOCUMENTS

| | | | |
|---|---|---|---|
| 4,424,514 | 1/1984 | Fennell et al. | 340/825.52 |
| 4,839,641 | 6/1989 | Mori et al. | 340/825.47 |
| 4,994,797 | 2/1991 | Breeden | 340/825.44 |
| 5,225,826 | 7/1993 | DeLuca et al. | 340/825.44 |
| 5,332,994 | 7/1994 | Kawashima et al. | 340/825.44 |
| 5,410,749 | 4/1995 | Siwiak et al. | 455/280 |
| 5,473,320 | 12/1995 | DeLuca et al. | 340/825.44 |
| 5,499,020 | 3/1996 | Motohashi et al. | 340/825.44 |
| 5,650,776 | 7/1997 | Mitchell et al. | 340/825.44 |
| 5,734,331 | 3/1998 | Makino | 340/825.44 |
| 5,796,338 | 8/1998 | Mardirossian | 340/568 |

FOREIGN PATENT DOCUMENTS 1-259633 10/1989 Japan .

*Primary Examiner*—Wellington Chin
*Assistant Examiner*—Congvan Tran
*Attorney, Agent, or Firm*—Young & Thompson

[57] ABSTRACT

In an alerting device for a pager, when a call with a message is received within a predetermined period of time of reception of an initial reception of a call including a message identical to that of the received message, the device conducts an alerting operation to help the user of the pager easily recognize the call. After the predetermined period of time, the device performs an ordinary notification to thereby minimize the current consumption. When a radio section receives a signal including data which matches an address assigned to the pager, a time counter initiates measuring the predetermined period of time and a decoder stores a message obtained from the signal in an RAM. When a next message is received, the decoder compares the received message with the stored one. When "matching" occurs between the messages, the decoder drives a loudspeaker with a large volume or a vibration motor with an increased amplitude when the time counter is measuring the predetermined period of time. After lapse of the predetermined period of time, the decoder drives the loudspeaker with an ordinary volume or a vibration motor with a usual amplitude.

13 Claims, 5 Drawing Sheets

ALERTING DEVICE FOR USE WITH A PAGER

BACKGROUND OF THE INVENTION

The present invention relates to an alerting device or a reporting device for a pager which includes notifying means such as a loudspeaker and a vibration motor and which is capable of receiving messages including numeric characters, Japanese syllabary or katakana, and Chinese characters or kanji.

DESCRIPTION OF THE RELATED ART

In general, a pager or beeper is called in accordance with a call number assigned there to. When a call is received, the pager reports or notifies the event of call to the person carrying the pager. For example, the pager produces a sound notification or drives a vibration motor to issue a vibration notification. Some pagers of this kind have a function responsive to reception of the same message. Namely, on receiving a message equal to a message previously received, there is displayed a repeated call stamp indication or there is produced an ordinary reception sound to notify the reception of the same message. Additionally, there is provided in some pagers a function similar to that of the pager described in the Japanese Patent Laid-Open Publication Ser. No. 1-259633. That is, when a message received is the same as the previous message, the sound volume of the ringing tone is stepwise increased in accordance with the number of receptions. With this provision, the chance of the user to respond to the call will be increased.

In the conventional pager described above, when the same message is received, the volume of the ringing tone becomes stepwise greater according to the number of call receptions. However, for example, even when there exists a considerable period of time between the receptions of the same message, the sound volume may possibly exert an adverse influence over the life of a battery installed in the pager. Furthermore, it may also be possible in this case that the same message is sent from another user for another purpose, not from the same user.

Recently, there have been widely utilized pagers which include, in addition to a loudspeaker, a vibration motor as means to notify the call reception to the carrier of the pager. Namely, in the wait state of the pager of this type, the notification mode is set to the vibrator mode, not to the loudspeaker mode, in many cases. That is, the same message call cannot be specifically reported to the user in the vibrator mode.

SUMMARY OF THE INVENTION

It is therefore an object of the present invention to provide an alerting device for a pager to solve the problem above in which when the same message call is received with an interval of time not exceeding a predetermined period of time relative to the first reception of the message call, the device reports the event so that the user can easily recognize the call reception. When the predetermined period of time is exceeded, the call is normally reported to the user to thereby minimize the current consumption of the pager.

In accordance with the present invention, there is provided an alerting device for use with a pager including notifying means operative when a radio signal including pager call information for a call of the pertinent pager for conducting a call notification and alert control means for achieving, when a radio signal including pager call information and a message is received within a predetermined period of time after reception of radio signal including pager call information and a message which are the same as those of the received radio signal, a control operation such that the notifying means issues a first call notification (to help the user recognize the notification) and conducting, when the radio signal is received after lapse of the predetermined period of time, a control operation such that the notifying means issues a second (ordinary) call notification.

Furthermore, in the alerting device for use with a pager in accordance with the present invention, the alert control means includes storage means for storing, when the radio signal including the pager call information and the message is received, the message therein; time counting means for starting a counting operation of a predetermined period of time beginning at the reception of the radio signal, first determining means for determining, when a radio signal including the pager call information and a message is received after reception or the radio signal, whether or not the message is substantially equal to that stored in the storage means; second determining means for determining, when the first determining means determines that the same message is included, whether or not a current point of time is within the predetermined period of time; first drive means for driving, when the second determining means determines that the current point of time is within the predetermined period of time, the notifying means to issue the first call notification; and second drive means for driving, when the second determining means determines that the current point of time is beyond the predetermined period of time, the notifying means to issue the second call notification.

Moreover, the alerting device for use with a pager in accordance with the present invention further includes plurality of time counting means and time counting control means for controlling the plural time counting means to sequentially start counting the predetermined period of time each time a radio signal including the pager call information is received.

In the alerting device for use with a pager in accordance with the present invention further includes the notifying means of a plurality of kinds, the first and second drive means provided in association with the notifying means, and selecting means for selecting either one of the notifying means in accordance with a value externally set thereto. The first and second drive means disposed for the notifying means selected by the selecting means drive the notifying means associated therewith in accordance with results of determination of the first and second determining means.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Description will now be given of an embodiment of the pager in accordance with the present invention.

Figure 1:
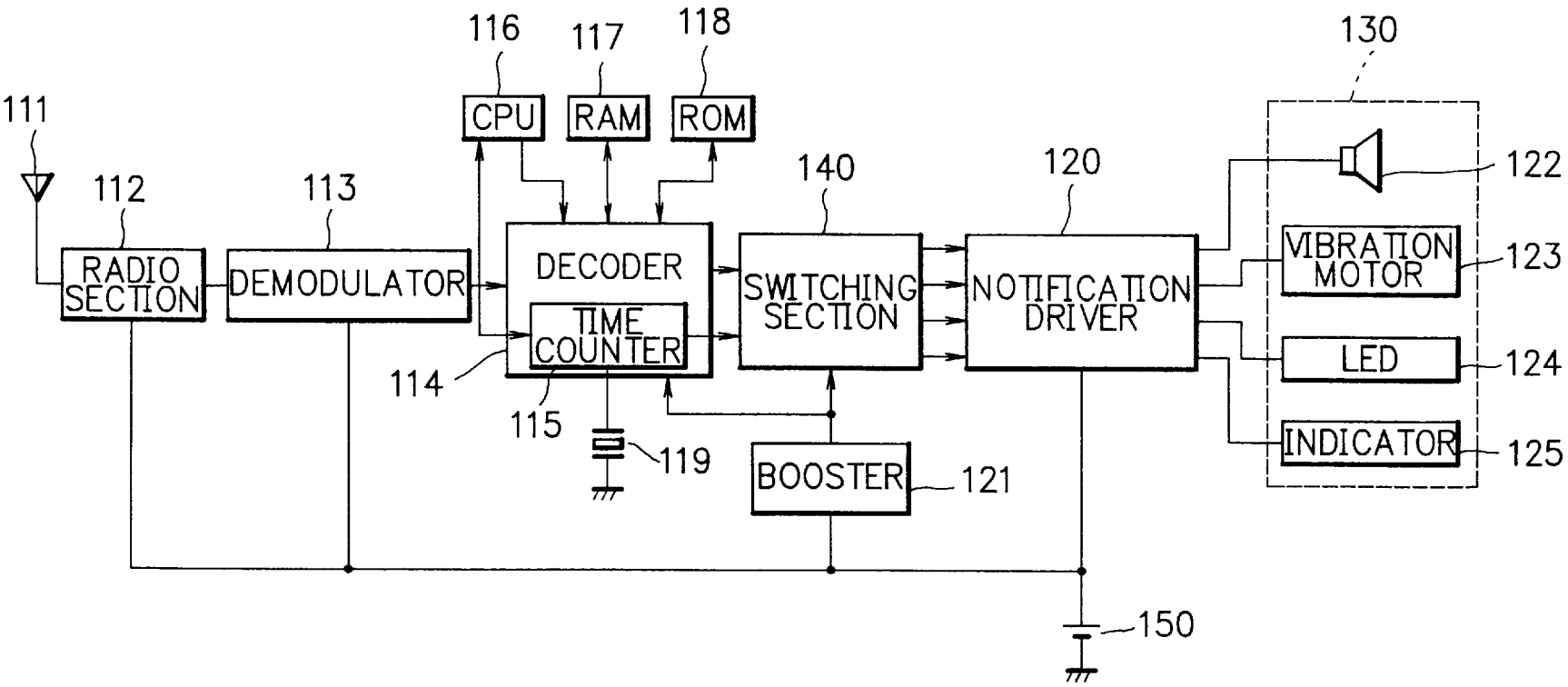
FIG. 1 is a schematic block diagram showing the configuration of an embodiment of a pager in accordance with the present invention.

FIG. 1 shows in a block diagram the constitution of the embodiment of the pager of the present invention. This pager includes a radio section 112 to receive via an antenna 111 signals sent from a transmitter and a demodulating section 113 to demodulate the signals received by the radio section 112 into recognizable data.

The configuration further includes a central processing unit (CPU) 116 to control the constituent components of the pager (e.g., to control a time counting operation of each time counter 115, which will be described later) according to programs stored in a read-only memory (ROM) 118. In addition to the programs, addresses uniquely assigned to the components of the pager and the like are stored in the ROM 118.

Moreover, the pager includes a decoder 114 to compare the data transformed by the demodulator 113 with an address of the pertinent pager stored in the ROM 118. When the data matches with the address, the decoder 114 produces a signal of message recognition information at a high level; otherwise, the decoder 114 generates the signal at a low level. When "matching" result, the decoder 114 sends a notification signal to a switching section 140 and stores data (message) following the address thereof in a random access memory (RAM) 117.

Additionally, the decoder 114 recognizes that the notification mode is set by the user of the pager to a loudspeaker mode or a vibrator mode. According to the result of recognition, the decoder 114 creates a sound signal or a vibration signal as the notification signal to be transmitted to the switching section 140. The decoder 114 then reports the recognized notification mode to the switching section 140.

The decoder 114 is linked with a crystal oscillator 119 externally provided to cooperate with n time counters 115 internally arranged. Using the time counters 115, the decoder 114 achieves a time counting operation to obtain, for example, the current time or a period of time lapsed after when a signal is received by the radio section 112.

In this connection, the construction of FIG. 1 includes only one time counter 115, i.e., the other counters 115 are not shown for simplification of the diagram.

The time counter starts the counting operation when the pager receives a signal from a transmitter to generate time count information which is at a low level until a fixed period of time (setting time t (s)) is measured relative to the reception start point and which is at a high level after lapse of the setting time t (s). The time counters 115 are assigned with priority levels. Namely, during an operation in which one of the time counters 115 is measuring the setting time t (s), when the radio section 112 receives another signal, the CPU 116 achieves a control operation to activate another one of the time counters 115 having a next lower priority level to commence the counting operation for the setting time t (s).

The time count information from the time counter 115 is outputted to the switching section 140. When the counting operation of setting time t (s) is terminated, the time count information is set to a low level. Recognizing the state of the information, the CPU 116 stops the counting operation of the time counter 115 having issued the time count information at the low level.

The switching section 140 delivers the information signal from the decoder 114 to either one of the input ports disposed in a notification driver section 120 in accordance with the notification mode and message recognition information from the decoder 114 and the time count information from the time counter 115.

The notification driver 120 drives a notifying section 130 including a loudspeaker 122, a vibration motor 123, a light emitting diode (LED) unit 124, and an indicator 125. That is, on receiving a call signal, the driver 120 blinks the LED 124 to notify the call to the user. When the data (message) sent to the pertinent address of the pager includes characters or the like, the driver 120 displays the character information on the indicator 125.

Moreover, in accordance with the port to which the notification signal is inputted, the driver 120 invokes either one of the loudspeaker 122 and the vibration motor 123 to report the call reception to the person carrying the pager. It is assumed that two input ports are provided for each of the loudspeaker 122 and the vibration motor 123 such that the sound volume or the amplitude of vibration varies depending on the port to which the notification signal is supplied.

Figure 2A:
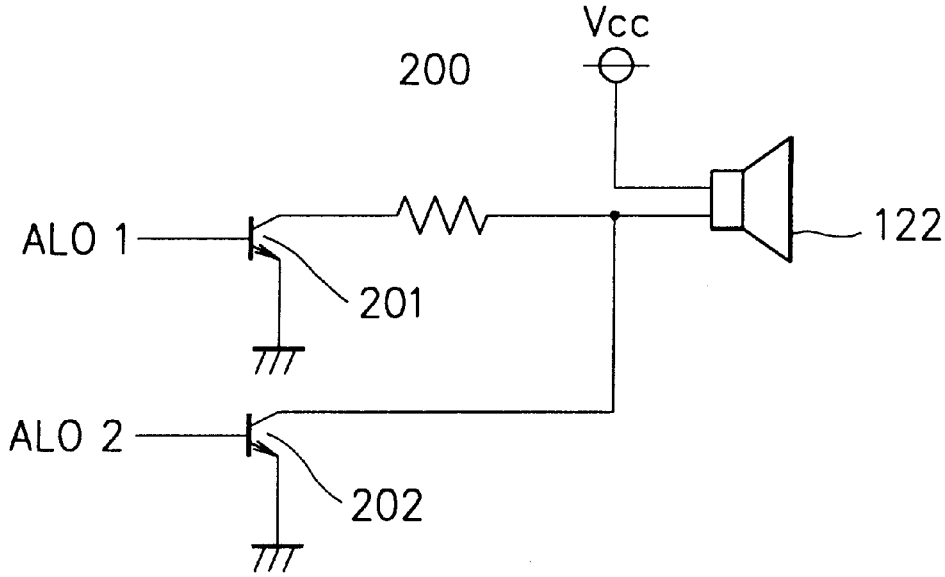
FIG. 2A is a diagram showing a driver circuit of a loudspeaker in a notification driving device of the pager.
Figure 2B:
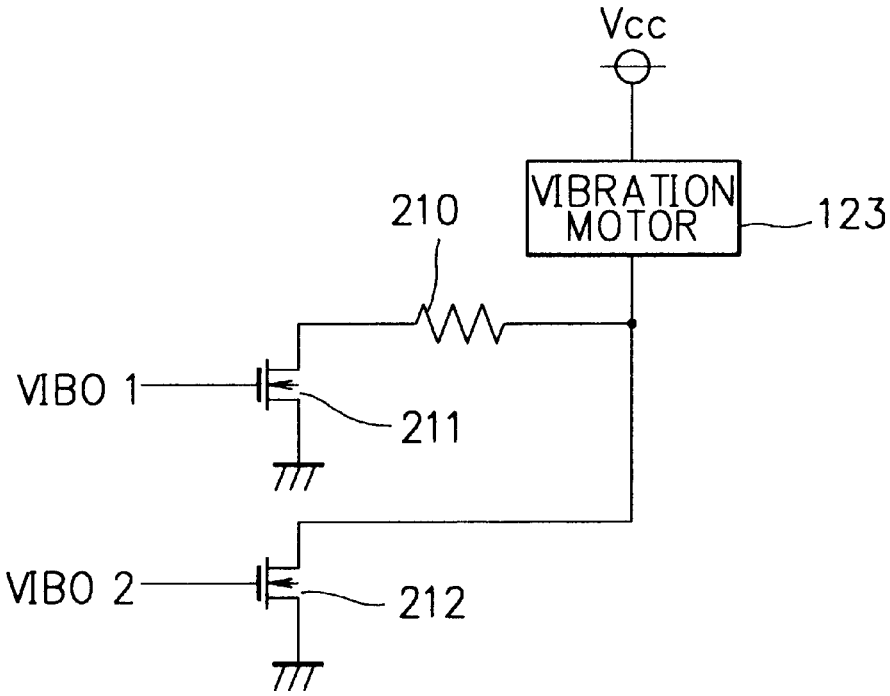
FIG. 2B is a diagram showing a driver circuit of a vibration motor in the notification driving device of the pager.

Specifically, and with further reference to FIGS. 2A and 2B, input ports AL01 and AL02 are arranged for the loudspeaker 122. When the notification (sound) signal is fed to the input port AL01, a sound having a normal volume is produced from the speaker 122. On the other hand, when the signal is delivered to the input port AL02, a sound with a greater volume is created from the speaker 122. Similarly, input ports VIB01 and VIB02 are disposed for the vibration motor 123. On receiving the notification (vibration) signal via the input port VIB01, the vibration motor 123 vibrates with a normal amplitude. In contrast therewith, on receiving the signal via the port VIB02, the vibration motor 123 vigorously vibrates with a higher amplitude.

In FIG. 1, only the signal lines to the input ports AL01 and AL02, VIB01, and VIB02 are shown between the switching section 140 and the notification driver section 120. Namely, signals lines to drive the LED 124 and the indicator 125 are not shown for simplification of the diagram.

FIGS. 2A and 2B partly show the internal circuits of the notification driver 120 in which FIG. 2A shows the driver circuit of the loudspeaker 122 and FIG. 2B shows that of the vibration motor 123. Although the driver 120 additionally includes circuits to drive the LED 124 and the indicator 125, the circuit constitution thereof are not shown for simplification of the description.

In FIG. 2A, the loudspeaker 122 includes an end supplied with a power source voltage $V_{cc}$ and another end coupled with a collector of a transistor 202 and a collector of a transistor 201 via a resistor 200. The transistors 201 and 202 respectively include bases respectively receiving the notification signals from the input ports AL01 and AL02, respectively. Each of the transistors 201 and 202 has an emitter connected to a ground potential.

In FIG. 2B, the vibration motor 123 includes an end to which the power source voltage $V_{cc}$ is supplied and another end linked with a drain of an n-channel field effect transistor (FET) 212 and a drain of an n-channel FET 211 via a resistor 210. The transistors 211 and 212 respectively include gates respectively receiving the notification signals from the input ports VIB01 and VIB02. Each of the transistors 211 and 212 includes a source coupled with a ground potential.

Returning to FIG. 1, the system includes a battery 150 to supply power to the constituent components of the pager and a boosting section 121 to boost the voltage of the battery 150 to voltages to respectively drive the decoder 114 and the switching section 140. The voltages are delivered to the decoder 114 and the switching section 140, respectively.

Next, description will be given of operation of the pager.

First, when the radio section 112 receives a signal, the demodulator 113 transforms the signal into a digital signal. The decoder 114 then compares the resultant data with the own address stored in the ROM 118. When "matching" takes place therebetween, the decoder 114 sends a notification signal related to the notification mode of the notification driver 120 in accordance with the switch control operation of the switching section 140. In response thereto, the speaker 122 or the vibration motor 123 notifies the call reception to the user. When the signal includes a message, the pager stores the message in the RAM 117.

In this operation, the decoder starts the counting operation of the setting time (s) relative to the reception point of the signal. On receiving another signal, the decoder 114 reads the previous message from the RAM 117 to discriminate whether or not the current message matches the previous message.

If "mismatching" takes place, i.e., if the messages are not equal to each other, the decoder 114 sends the time count information (high within t (s) and low after lapse of t (s)) and data of message recognition information (low for "mismatching" between the messages) to the switching section 140. After the message comparison is finished, the system updates the message stored in the RAM 117 with the current message last received.

The decoder 114 confirms the present notification mode to notify the recognized notification mode to the switching section 140. Moreover, the decoder 114 sends a sound signal as the notification signal a vibration signal respectively in the speaker and vibration modes to the switching section 140. Resultantly, when the notification mode is the speaker mode, the switching section 140 carries out a control operation to deliver the sound signal to the input port AL01 and a signal (at a low level) which is invalid as a notification signal to the input ports AL02, VIB01, and VIB02. Responsively, in FIG. 2A, the transistor 202 is turned off and the sound signal is fed to the base of the transistor 201 to supply a current via the resistor 200 to the loudspeaker 122, which therefore produces a sound with an ordinary volume.

When the notification mode is the vibration mode in the operation above, the switching section 140 accomplishes a control operation to feed the vibration signal (at a high level) to the input port VIB01 and a signal (at a low level) ineffective as a notification signal to the input ports VIB02, AL01, and AL02. Resultantly, as shown in FIG. 2B, the transistors 211 and 212 are respectively turned on and off and a drive signal is inputted through the resistor 210 to the vibrator 123, which accordingly vibrates with an ordinary amplitude or intensity.

Conversely, when the contents of the preceding message match those of the current message, if the time counter 115 incorporated in the decoder 114 is conducting a time counting operation beginning at the reception of signal (within t (s) of the reception), the decoder supplies the time count information (at a thigh level within t (s)) and the message recognition information (at a high level for "matching" between the messages) to the switching section 140.

In response thereto, the switching section 140 performs a control operation to send in the speaker mode the sound signal to the input port AL02 of the notification driver 120 and a signal invalid as the notification signal to the input ports AL01, VIB01, and VIB02. Resultantly, in FIG. 2A, the transistor 201 is turned off to feed the sound signal to the base of the transistors 202 such that the speaker 122 produces a sound with a sound volume higher than the ordinary volume as above.

In the vibration mode, the switching section 140 accomplishes a control operation to transmit the vibration signal to the input port VIB02 and a signal invalid as the notification signal to the input ports VIB01, AL01, and AL02. As a result, in FIG. 2B, the transistors 212 and 211 are respectively turned on and off and hence the vibration motor 123 vibrates with an amplitude greater than the ordinary amplitude.

On the other hand, when "matching" occurs between the received messages, if at least the setting time t (s) lapses after the time counting operation is initiated at the previous signal reception, the time count information from the time counter 115 is set to a low level. Recognizing the condition, the CPU 116 stops the counting operation of the time counter 115 having transmitted the time count information at the low level. Accordingly, the decoder 114 sends the time count information at the low level and the message recognition information at a high level to the switching section 140. Resultantly, the section 140 accomplishes a control operation to sent an ordinary signal as the notification signal to the notification driver 120, i.e., to the input port AL01 or VIB01 of the driver 120.

Figure 5:
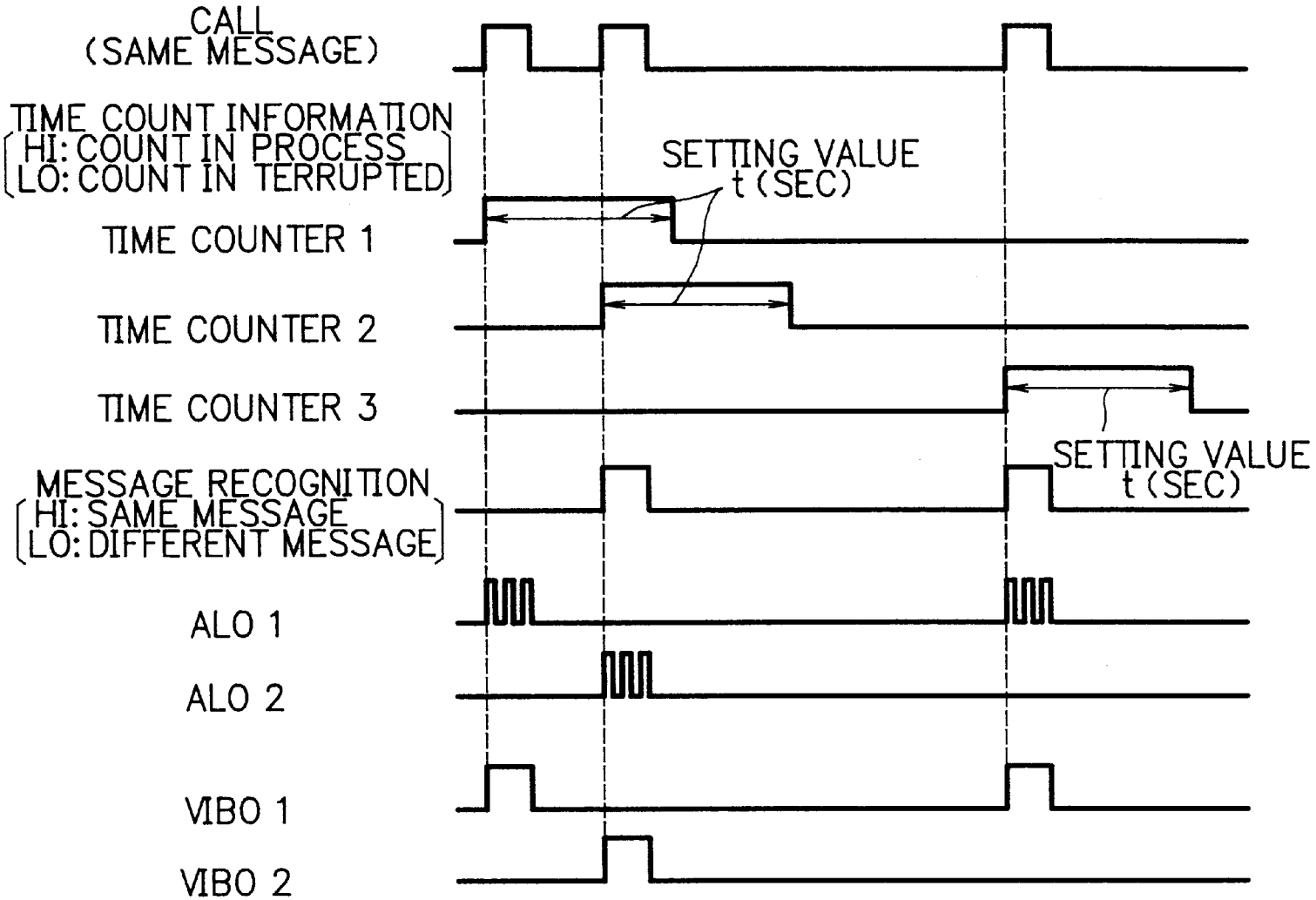
FIG. 5 is a signal timing chart of various signals in the pager.

FIG. 5 is a signal timing chart showing the operation described above. Description will now be given of the operation of the time counter 115. First, when the first call signal is received, a first time counter (having the highest priority level) commences the time counting operation to measure the setting time t (s) relative to the pertinent signal reception. Subsequently, on receiving the second call signal, a second time counter starts the counting to measure the setting time t (s) relative to the pertinent signal reception.

In this way, at reception of the third call signal, a third time counter starts the counting operation. Namely, each time a call signal is received, the time counter having the next highest priority level initiates the time counting.

As above, in the pager including the indicator 125, the notification driver 120 may also notify in characters and/or letters the event of reception of the messages having the same contents.

Figure 3:
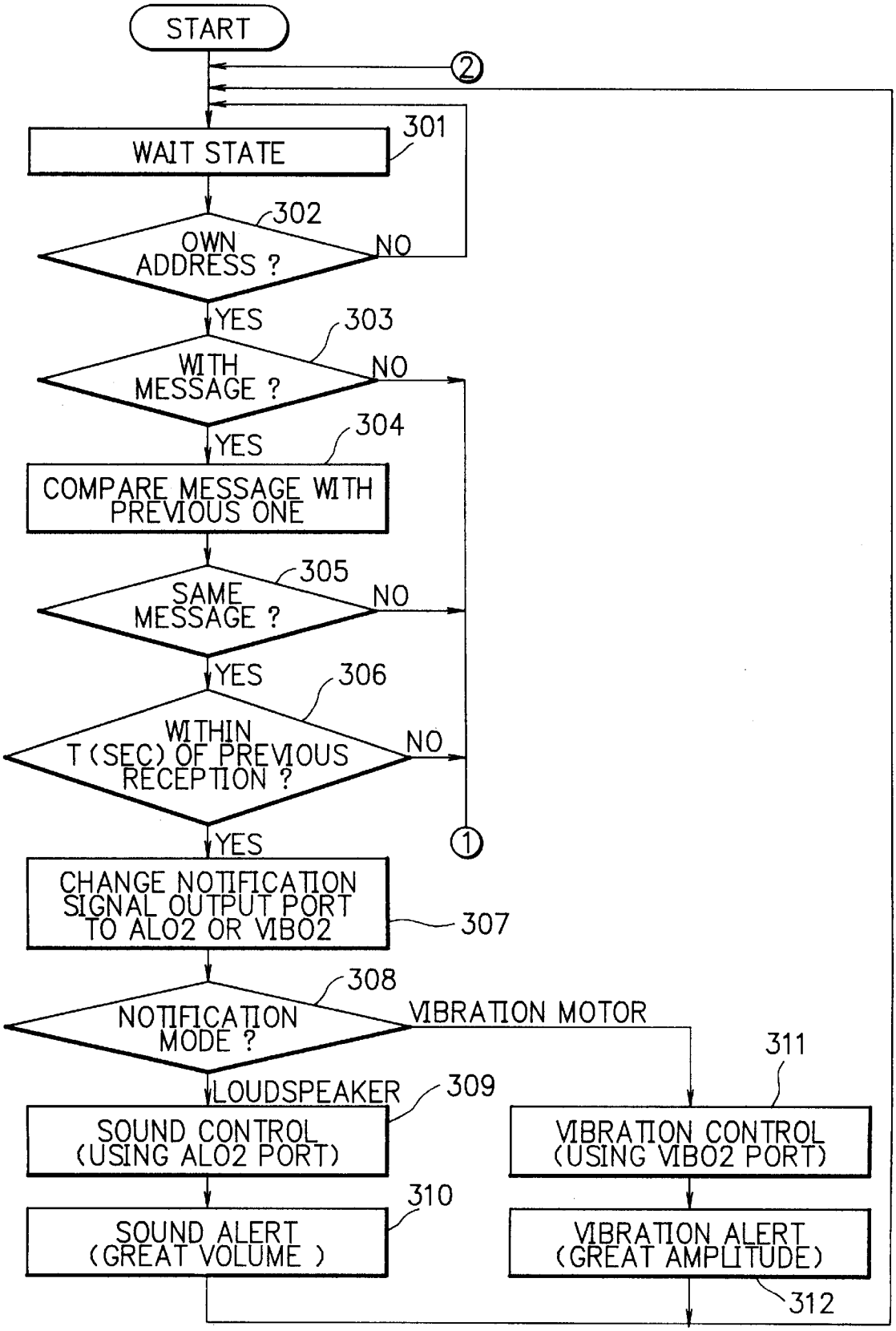
FIG. 3 is a flowchart partially showing operation of the processing in the pager.
Figure 4:
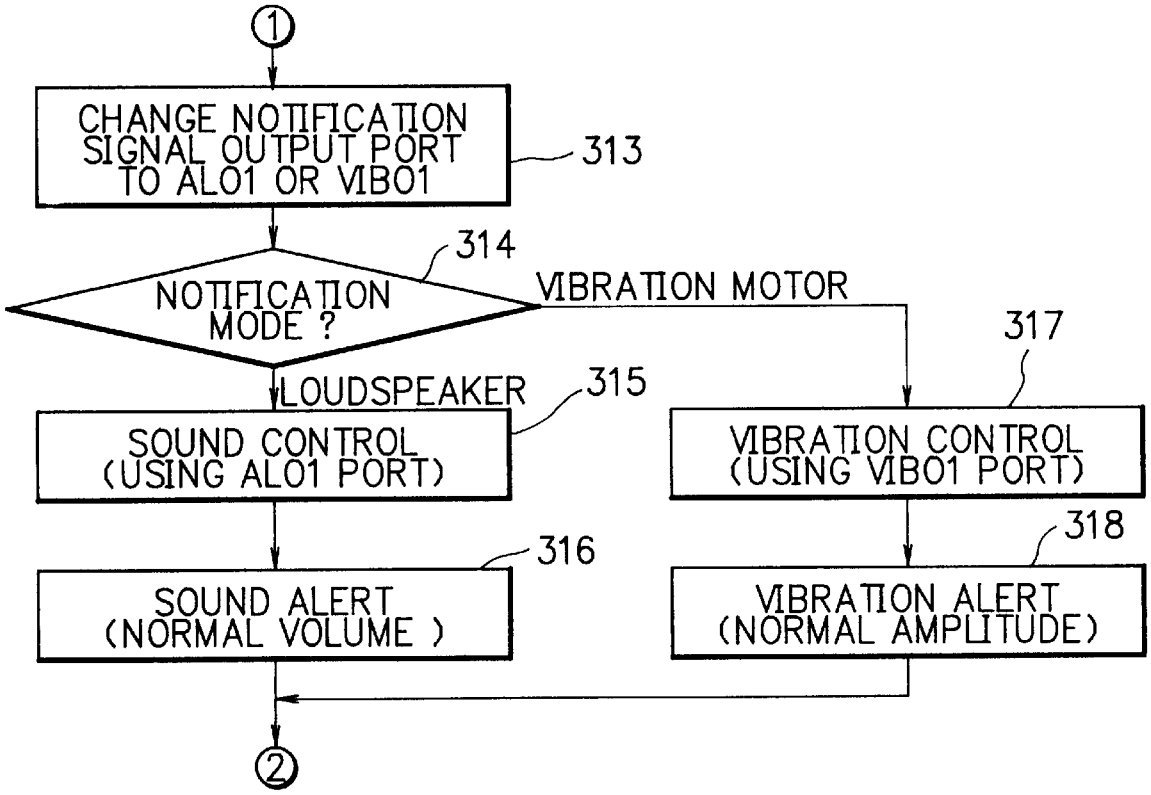
FIG. 4 is a flowchart showing another portion of operation of the processing in the pager.

Referring now to the flowcharts of FIGS. 3 and 4, description will be given of operation of the pager in the embodiment above.

Receiving first a signal in the wait state (step 301), a check is made to determine whether or not the signal includes data indicating the own address of the pertinent pager (step 302). If such an address is missing, the system returns again to the wait state; otherwise, a check is conducted to confirm presence or absence of a message (step 303).

If the received signal includes a message, the previous message is read from the RAM 117 to be compared with the current message (step 304) to determine whether or not these messages are equal to each other (step 305). After the determination, the previous message is updated to the current message in the RAM 117.

When it is decided that the messages are identical to each other in step 305, it is determined whether or not the time count measured beginning at the previous signal reception is less than the setting time t (s) (step 306).

If the setting time t (s) is not exceeded in step 306, the switching section 140 changes the input port of the notification driver 120 as the destination of a notification signal to the input port AL02 or VIB02 (step 307). The current notification mode of the pager is then examined (step 308). If the notification mode is the speaker mode, a notification (sound) signal is sent to the input port AL02 (step 309). As a result, the loudspeaker 122 creates a sound with a larger sound volume (step 310).

Additionally, when the notification mode is the vibrator mode in step 308, a notification (vibration) signal is outputted to the VIB02 port (step 311). Therefore, the vibration motor 123 vibrates with a higher intensity (step 312).

On the other hand, the switching section 140 changes the output destination of the notification signal to the input port AL01 or VIB01 ① when a message is missing in the received signal, i.e., when only a call is received in step 303, ② when the previous message is different from the current message in step 305, and ③ when the setting time t (s) relative to the previous signal reception is exceeded by the measured time in step 306 although the previous message is different from the current message.

The current notification mode is investigated (step 314). If the notification mode is the loudspeaker mode, a notification (sound) signal is fed to the AL01 port (step 315). Accordingly, the loudspeaker 122 generates a sound with an ordinary volume (step 316). When the notification mode is the vibrator mode in step 314, a notification (vibration) signal is fed to the VIB01 port (step 317). Consequently, the vibrator 123 vibrates with an ordinary amplitude (step 318).

Description has been given of the control operation in association with reception of the messages including the same contents. However, at reception of other messages (of which the contents are different from each other), the notification is achieved also via the ordinary ports (AL01 and VIB01).

In accordance with the present invention, when a call is received within a preset period of time relative to a preceding call, if the messages of these calls are equal to each other, notifying means issues a first notification. When the same message is received after lapse of the preset period of time, the notifying means issues a second notification. With this provision, in a case in which the notifying means is, for example, a loudspeaker and the first and second notifications are respectively a notification with a higher sound volume and a notification with an ordinary sound volume, when the carrier of the pager does not recognize the call even after the call is repeatedly received by the pager many times, the loudspeaker produces a sound with a volume greater than that of the ordinary call. This makes it possible for the user to easily recognize the call reception. In addition, when the same message is received after the lapse of the preset time, the loudspeaker generates a sound with an ordinary volume. This consequently does not minimize the life of the battery due to the notification with a louder sound.

Moreover, in accordance with the present invention, there are provided a plurality of time counting means, which sequentially measure the predetermined period of time each time a call is received. Therefore, when a call is received during a time counter is measuring lapse of time, another time counter starts the counting operation for the subsequent calls. Thanks to the operation, even when a call is repeatedly conducted several times while a time counter is in process, the time counting operation can be accomplished for each call. In consequence, even in a case in which a call is repeatedly conducted several times within a predetermined period of time relative to the initial call, there can be achieved a control operation such that the notifying means issue the first notification for each call.

Additionally, in accordance with the present invention, the user of the pager can specify either one of the notifying means of a plurality of kinds. When a call is again notified by the specified notifying means within the predetermined period of time, if the same message is received, the notifying means issues the first notification. If the same message is received after lapse of the predetermined period of time, the notifying means issues the second notification. Therefore, in a pager including a plurality of notifying means such as a loudspeaker and a vibration motor, the notifying means can be selected in accordance with the environments of the pager. Moreover, for the carrier of the pager does not recognize the call even after the call is repeatedly received many times, recognition of the call reception is facilitated. This makes it possible for the user to easily recognize the call reception. Additionally, when the same message is received after the lapse of the preset time, the operation mode is returned to the ordinary notification mode, which accordingly does not minimize the battery life.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A pager comprising:

a message receipt indicator with at least two indication levels;

a first timer measuring a first time period following receipt of a first message;

a decoder connected to said first timer that determines whether a second message received after the first message has the same content as the first message and, if the second message has the same content as the first message, determines whether the second message was received within the first time period following receipt of the first message; and a switch connected to said controller and said message receipt indicator causing said message receipt indicator to indicate receipt of the second message at a first of the two indication levels when the second message does not have the same content as the first message or was not received within the first time period following receipt of the first message and causing said message receipt indicator to indicate receipt of the second message at a second of the two indication levels when the second message has the same content as the first message and was received within the first time period following receipt of the first message.

2. The pager of claim 1, further comprising a second timer independent of said first timer measuring a second time period following receipt of the second message that may be the same or different from the first time period.

3. The pager of claim 2, further comprising a crystal oscillator connected to said first timer and said second timer.

4. The pager of claim 1, wherein said message receipt indicator comprises a speaker circuit and the second indication level is louder than the first indication level.

5. The pager of claim 4, wherein said speaker circuit comprises a speaker, a power source for said speaker, a first transistor connecting said speaker to ground through operation of a gate connected to said switch, said first transistor being connected to said speaker through a first resistor, and a second transistor connecting said speaker to ground through operation of a gate connected to said switch.

6. The pager of claim 1, wherein said message receipt indication comprises a vibration circuit and the second indication level is a more rigorous vibration than the first indication level.

7. The pager of claim 6, wherein said vibration circuit comprises a vibrator, a power source for said vibrator, a first transistor connecting said vibrator to ground through operation of a gate connected to said switch, said first transistor being connected to said vibrator through a first resistor, and a second transistor connecting said vibrator to ground through operation of a gate connected to said switch.

8. A pager comprising:

an indicator with at least two message receipt indications;

at least two independent timers, a first of said timers measuring a first time period following a first received message and a second of said timers measuring a second time period following a second received message that may be the same or different from the first time period;

a decoder connected to said timers that determines whether the second message is the same as the first message and, if the second message is the same as the first message, determines whether the second message was received within the first time period following the first message, and that determines whether a third received message is the same as the second message and, if the third message is the same as the second message, determines whether the third message was received within the second time period following the second message; and a switch connected to said controller and said indicator causing said indicator to indicate receipt of the second message with a first of the two indications when the second message is not the same as the first message or was not received within the first time period following the first message and causing said indicator to indicate receipt of the second message with a second of the two indications when the second message is the same as the first message and was received within the first time period following the first message, and causing said indicator to indicate receipt of the third message with the first of the two indications when the third message is not the same as the second message or was not received within the second time period following the second message and causing said indicator to indicate receipt of the third message with the second of the two indications when the third message is the same as the second message and was received within the second time period following the second message.

9. The pager of claim 8, further comprising a crystal oscillator connected to said at least two timers.

10. The pager of claim 8, wherein said indicator comprises a speaker circuit and the second indication is louder than the first indication.

11. The pager of claim 10, wherein said speaker circuit comprises a speaker, a power source for said speaker, a first transistor connecting said speaker to ground through operation of a gate connected to said switch, said first transistor being connected to said speaker through a first resistor, and a second transistor connecting said speaker to ground through operation of a gate connected to said switch.

12. The pager of claim 8, wherein said indicator comprises a vibration circuit and the second indication is a more rigorous vibration than the first indication.

13. The pager of claim 12, wherein said vibration circuit comprises a vibrator, a power source for said vibrator, a first transistor connecting said vibrator to ground through operation of a gate connected to said switch, said first transistor being connected to said vibrator through a first resistor, and a second transistor connecting said vibrator to ground through operation of a gate connected to said switch.

* * * * *